United States Patent [19]

Mattox

[11] 4,105,538

[45] Aug. 8, 1978

[54] PROCESS FOR THE REFINING OF USED MOTOR OILS AND PRODUCTS THEREOF

[76] Inventor: William J. Mattox, 612 S. Lakeshore Dr., Baton Rouge, La. 70808

[21] Appl. No.: 761,080

[22] Filed: Jan. 21, 1977

[51] Int. Cl.[2] ..... C10M 11/00

[52] U.S. Cl. ..... 208/18; 208/180; 208/181; 252/388

[58] Field of Search ..... 208/180, 181, 18

[56] References Cited

U.S. PATENT DOCUMENTS

| | | | |
|---|---|---|---|
| 1,882,002 | 10/1932 | Dietrich | 208/180 |
| 1,990,359 | 2/1935 | Ambler | 208/180 |
| 2,162,195 | 6/1939 | Greensfelder et al. | 208/180 |
| 2,568,583 | 9/1951 | Graves | 208/180 |
| 2,951,031 | 8/1960 | Barclay | 208/180 |
| 3,282,827 | 11/1966 | Grysiak | 208/180 |
| 3,305,478 | 2/1967 | Gilson et al. | 208/180 |
| 3,985,642 | 10/1976 | Friel et al. | 208/180 |

*Primary Examiner*—Herbert Levine
*Attorney, Agent, or Firm*—Bacon & Thomas

[57] ABSTRACT

Contaminants produced in lubricating oils during use in internal combustion engines are converted to removable particulate matter by treatment with an amine. If an amine of higher activity is employed, the resulting refined product is re-usable as a lubricating oil and if an amine of lower activity is employed, the resulting product can be used as a corrosion inhibitor for metal surfaces.

10 Claims, No Drawings

PROCESS FOR THE REFINING OF USED MOTOR OILS AND PRODUCTS THEREOF

BACKGROUND OF THE INVENTION

Used motor oil has been known for many years as a metal preservative and has had very limited use as a rust inhibitor on oil drilling equipment, the protection of farm machinery, etc. The effectiveness of the used oil has previously been attributed to the thickening resulting from the accummulated contaminants which keep it from soaking in and from evaporating. However, there has never been any widespread use for these contaminated oils. Rather, there have been numerous problems associated with such efforts. For example, the relatively high cost of collecting a large number of small quantities, the ultimate disposal of unwanted material by methods compatible with environmental protection, etc., have not found economic justification.

In recent years some small scale re-refining methods have been put into operation in which marketable oils are recovered. However, due to the high costs involved and the resulting narrow margin of profit, such recovery methods represent a small percentage utilization of the total quantity of used motor oils.

A much larger utilization of used lubricant consists of treatment with acid, etc. to partially clean it so that it may be blended with fresh oil and burned as fuel. However, such utilization destroys valuable lubricating and corrosion inhibiting components at much less valuable fuel oil price levels.

The ever increasing scarcity and consequent high cost of petroleum, particularly high quality lubricating stocks, now presents positive incentives to selectively remove undesirable contaminants from used motor oils and reuse the valuable high quality lubricating components contained in such oils. A process has now been discovered whereby this may be accomplished in an economical manner.

DETAILED DESCRIPTION OF THE INVENTION

The newly discovered process according to the present invention comprises contacting the used motor oil containing contaminants produced during its use by any of a variety of suitable methods at essentially ambient or somewhat elevated temperatures with a minor proportion of an oil-soluble amine for a period sufficient to render at least a portion of said contaminants physically removable by (1) causing conglomeration of suspended non-lubricating contaminants and/or (2) to making less soluble or insoluble the objectionable non-lubricating materials which may be in solution in the oil. Such soluble materials may comprise organic acids and other oxygen containing components or organo-metallic salts, etc., formed as a result of partial oxidation of oil components at the relatively high temperatures to which the oil is exposed during use in the engine. The resulting insoluble sludge and/or solid particulate matter is separated by settling, decantation, filtration, percolation over solid adsorbents, centrifugation or other suitable means.

The treatment of used motor oils may be carried out at an elevated temperature in the absence of a substantial quantity of extraneous solvent or it may be facilitated by dilution of the heavy oil with moderate amounts of a relatively light hydrocarbon fraction or other type solvent during the period of treatment with the amine and the subsequent separation of the precipitated contaminants. The light solvent, preferably a hydrocarbon or hydrocarbon derivative, may be a material normally gaseous at atmospheric pressure or it may be a relatively volatile liquid boiling within the range of that of paraffinic hydrocarbons of 5 to 8 carbon atoms. A suitable solvent will be one boiling in the $C_3$–$C_8$ range. The solvent may be readily removed from the treated, decontaminated oil by distillation at atmospheric or near atmospheric pressure and relatively low temperatures.

If the treated oil is to be used for spray lubricants, corrosion or rust inhibitor applications, etc., the solvent used in the purification step will preferably be one also suitable for use in the final products so that no separation of these components from the treated motor oil will be required. In these applications a higher and/or wider boiling range of solvents may be employed, but it is preferred that the solvent boil within the $C_6$ to $C_{12}$ paraffinic hydrocarbon range.

If the purified oil is to be reused as motor oil, it may be desirable to remove any excess of amine along with the solvent employed in the process. The amine-solvent mixture may then be recycled to the treating step. However, any relatively small amount of amine will not usually be objectionable and in most instances will enhance desirable performance characteristics, particularly corrosion inhibition.

It has been found that any amine which is soluble in the used motor oil being treated can be used either to produce a product reusable as an engine lubricant or as a corrosion inhibiting or similar composition. Thus, the amine may be an aliphatic (saturated or unsaturated), alicyclic (saturated or unsaturated), aryl or aralkyl amine. The amine may be primary, secondary or tertiary in nature, and when secondary or tertiary, the N-substituents may be the same or different. When different, the substituents may be of a similar class or they may be of different chemical classes as enumerated above. It will be understood that reference to an amine in this specification and the annexed claims is intended to cover a single amine or a mixture of amines.

The amines, however, are of widely varying activity in removing the contaminants developed during the use of motor oils. The relative activity of a particular amine in comparison to others can readily be determined by contacting a sample of used oil in a transparent cylindrical container with the amine, and measuring the height of the solid particulate matter which collects in the bottom of the container, the greater the height, the more active is the amine in removing contaminants.

The more active amines are capable of removing substantially all of the contaminants developed in the use of the lubricating oil, and accordingly such an amine will be selected as the treating agent when it is desired that the refined product be one reusable as a lubricant for motors, particularly internal combustion engines.

On the other hand, the less active amines have the ability to remove undesirable contaminants from the used oil, while leaving in solution in their original or altered form, the contaminants which have been observed to give used motor oils a corrosion inhibiting property, as pointed out above. Thus, it will be obvious that an amine of lesser activity will be selected as the treating agent when it is desired that the refined product be used as a corrosion inhibiting or similar composition.

Included amongst the components of the used oil which remain in solution are ones having surfactive properties which make the resulting product particularly valuable. The treated and clarified product has the ability to displace water making it suitable for freeing rusted parts. It will obviously have lubricating properties, and it is highly valuable for a variety of industrial, automotive, home and marine uses.

The following table is a partial listing of available amines having varying activities suitable for treating used lubricating oils either to refine to new lube oil quality or to produce a corrosion inhibiting, penetrating oil, etc., composition:

TABLE 1

Allylamine
Allylcyclohexylamine
2-Amino-5-diethylaminopentane
2-Amino-3,3-dimethylbutane
Amino-diphenylmethane
N-(2-aminoethyl)-1,3-propanediamine
Aminoheptane
n-Amylamine
Benzylamine
Benzylmethylamine
Bis-(2-aminopropyl)-amine
Butylamine
Cycloheptylamine
Cyclohexanemethylamine
Cyclohexylamine
Cyclooctylamine
Cyclopentylamine
Cyclopropylamine
Decylamine
Diallylamine
Dibenzylamine
Di-n-butylamine
Dicyclohexylamine
Diethylamine
3-Diethylaminopropylamine
N-N'-diethyl-2-butene-1,4-diamine
N,N-diethylcyclohexylamine
Diethylenetriamine
N,N-diethylethylenediamine
N,N'-diethyl-1,3-propanediamine
di-n-hexylamine
Diisobutylamine
Diisopropylamine
N,N-diisopropylethylamine
Dimethylamine
3-Dimethylaminopropylamine
1,2-Dimethylbutylamine
Dimethylethylenediamine
Dimethylhexylamine
Di-n-nonylamine
Diaminobutane
Diaminocyclohexane
1,10-Diaminodecane
1,2-Diaminododecane
1,7-Diaminoheptane
1,2-Diamino-2-methylpropane
1,8-Diaminooctane
1,5-Diaminopentane
1,2-Diaminopropane
Di-n-octylamine
1,2-Diphenylethylamine
3,3-Diphenylpropylamine
Dipropylamine
Dodecylamine
Ethylamine
Ethylenediamine
N-ethylethylenediamine
N-heptadecylamine
N-heptylamine
1-Hexadecylamine
1,6-Hexanediamine
Isoamylamine
Isopropylamine
2-Methylallylamine
Methylamine
Methylcyclohexylamine
N-nonylamine
Octadecylamine
Octylamine
Phenylamine
Propylamine
1-Tetradecylamine
Tributylamine
Triethylamine
Trimethylamine
Tripropylamine
N-undecylamine Certain of the treated or re-refined oils prepared in accordance with the disclosures of this invention have been found to have unique corrosion inhibiting properties superior to those inherent in virgin oils or in used oils of higher viscosity due to accummulated suspended contaminants. These results show that the described treating or re-refining process which employs the proper amine selectively retains the corrosion inhibiting compounds formed during use of the oil in the engine while removing undesirable components formed simultaneously during this use. The re-refined or decontaminated oils are also amenable to further increases in anti-corrosion effectiveness by inclusion of certain known compatible oil-soluble additives. By way of illustration, a suitable additive of this type may comprise one or more alkanolamine salts such as a phosphate-ester acid neutralized with an alkanolamine. Inclusion of suitable surfactive materials will usually be desirable.

EXAMPLE 1

Motor oil was removed from an automobile engine after prolonged use and which at ambient temperatures was highly viscous and completely black. The used oil was diluted with an equal volume of a light paraffinic hydrocarbon fraction, boiling in the approximate range of 95 to 145° C. An individual amine was then added to equal portions of the diluted used oil in an amount equivalent to 10.8 parts by weight per 100 parts of used motor oil. The solutions were thoroughly mixed and allowed to stand in glass containers without further agitation at ambient temperature (75°–85° F). Each container was then examined for solids separation as evidenced by their accummulation in the bottom of the container. The clarity and color of the treated oil was also observed. The results are set forth in the following table:

TABLE 2

| Amine Used | Boiling Point ° C | Scale Showing Relative Effectiveness in Removing Solids* | Appearance | |
|---|---|---|---|---|
| | | | Clarity | Color |
| Ethylenediamine | 117 | 1.0 | Clear | Amber |
| Butylamine | 77 | 0.7 | Clear | Amber |
| Benzylamine | 185 | 0.7 | Slightly Cloudy** | Reddish Orange |

TABLE 2-continued

| Amine Used | Boiling Point ° C | Scale Showing Relative Effectiveness in Removing Solids* | Appearance Clarity | Appearance Color |
|---|---|---|---|---|
| Phenethylamine | 195 | 0.7 | Slightly Cloudy** | Reddish Orange |
| 1,3-Propanediamine | 138 | 0.6 | Clear | Amber |
| Dicyclohexylamine | 256 | <0.1 | Slightly Cloudy** | Dark Reddish Orange |
| Tributylamine | 214 | <0.1 | Cloudy | — |
| Di-2-Ethylhexylamine | 250+ | <0.1 | Clear | Red |
| Tripropylamine | 150–156 | <0.1 | Clear | Red |

*Ethylenediamine was arbitrarily assigned a value of 1.0 on the scale
**Clarified with increased time From the data of Table 2, it can be seen that a wide range of contaminant/sludge/particulate removal is possible, depending on the amine used. For treatment to obtain a product reusable as lubricating oil, one of the first four or five amines listed at the beginning of the table would be used. For selective treatment to remove sludge without removal of corrosion inhibiting components, one of the amines in the lower portion of the table would be selected.

Removal of the hydrocarbon solvent and excess amine from the oil treated with the more active amines yielded purified lubricating oil of high quality having gravity and color characteristics typical of virgin oils.

EXAMPLE 2

Clarified used motor oil solutions were prepared by amine treatment as in Example 1 and separated by decantation or centrifugation from the precipitated contaminants. Without removal of solvent from the oil, small amounts of an alkanolamine salt (phosphate-ester acid neutralized with amine) were added as supplemental inhibitors. Separate test specimens of steel plate, SAE alloy #1015 were coated with the oil solutions thus prepared, and an aqueous salt solution was applied once daily to each specimen. The specimens were observed at intervals of one, two and three weeks, and the percent of the surface of each plate which had rusted was estimated.

The results are set forth in the following table:

TABLE 3

| Amine Used | Molecular Weight | Boiling Point ° C | Effectiveness in Removing Solids* | Surface of Per Cent/Specimen Rusted 1 week | 2 weeks | 3 weeks |
|---|---|---|---|---|---|---|
| Ethylenediamine | 60 | 117 | 1.0 | 70 | 100 | 100 |
| Tripropylamine | 143 | 156 | <1.0 | 38 | 50 | 100 |
| Tributylamine | 185 | 214 | <1.0 | 32 | 32 | 88 |

*Evaluated as described in Example 1

In Table 3 it is shown that by selective treatment of the used oil, highly effective corrosion inhibiting components can be retained in the treated oil while removing the undesired contaminants and sludge. Severe treatment with ethylenediamine gives a clear oil with heavy sludge removal, but also gives reduced corrosion protection. The corrosion protection afforded by tributylamine treated oil (at two weeks test period) in three times the rust protection given by ethylenediamine treated oil, and tripropylamine treated oil gives twice the rust protection of ethylenediamine treated oil.

EXAMPLE 3

To further illustrate the effectiveness of the metal corrosion inhibitors formed in motor oils during use in internal combustion engines, corrosion evaluations were made on the same brand of oil as fresh unused oil, as oil subjected to mild service by primarily low speed city driving and as oil subjected to severe service by prolonged high speed highway driving. The used oils in 20% concentration with light hydrocarbon solvent were clarified by addition of tributylamine as described in Examples 1 and 2. Portions of the respective products were applied as thin films to steel test strips, SAE alloy #1015. The coated test strips were sprayed daily with aqueous salt solutions, and a measure of rust formation recorded as the tests progressed. The results are set forth in the following table:

TABLE 4

| Oil Applied | Per Cent of Surface of Specimen Rusted One Week | Two Weeks |
|---|---|---|
| Unused Oil | 76 | 100 |
| Mild Service Used Oil | 38 | 76 |
| Severe Service Used Oil | 16 | 38 |

The data show very substantial improvements in metal corrosion inhibition as the severity of the oil use increased indicating that corrosion inhibitor compounds are progressively formed in such oils during use. It is further demonstrated that low value used oils may be selectively refined to produce clarified high value, useful products which retain the corrosion inhibitor compounds.

Having described the invention, what is claimed is:

1. A process for selectively refining used motor oil containing contaminants developed in use, comprising contacting said motor oil with an amine soluble in the oil, said amine being selected from the group consisting of dicyclohexylamine, tributylamine, di-2-ethylhexylamine and tripropylamine and having an activity which renders a first portion of said contaminants which does not have corrosion inhibiting properties physically removable but leaves another portion of said contaminants having corrosion inhibiting properties in solution in the oil and physically removing said first portion.

2. The process of claim 1 wherein the used motor oil has been used in an internal combustion engine.

3. The process of claim 2 wherein the treated contaminants are removed by settling, filtration or centrifugation.

4. The process of claim 2 which is carried out at an elevated temperature in the absence of a substantial quantity of extraneous solvent.

5. A process for selectively refining used motor oil containing contaminants developed in use, comprising contacting said motor oil diluted by a light solvent with an amine soluble in the oil, said amine being selected from the group consisting of dicyclohexylamine, tributylamine, di-2-ethylhexylamine and tripropylamine and having an activity which renders a first portion of said contaminants which does not have corrosion inhibiting properties physically removable but leaves another portion of the contaminants having corrosion inhibiting properties in solution in the oil, and physically removing said first portion.

6. The process of claim 5 wherein the used motor oil has been used in an internal combustion engine.

7. The process of claim 6 wherein the solvent is a paraffinic hydrocarbon solvent boiling in the $C_6$ to $C_{12}$ range.

8. The process of claim 6 wherein the solvent is a light hydrocarbon solvent, said solvent and excess amine being removed by distillation.

9. The process of claim 8 wherein the solvent is one boiling in the $C_3$ to $C_8$ range.

10. The product prepared by the process of claim 1.

* * * * *